United States Patent [19]

Hodulik

[11] Patent Number: 4,887,509

[45] Date of Patent: Dec. 19, 1989

[54] SHOTSHELL DIE SET

[76] Inventor: Robert F. Hodulik, Box 117, RD #3, Hampton, N.J. 08827

[21] Appl. No.: 221,089

[22] Filed: Jul. 19, 1988

[51] Int. Cl.[4] ..... F42B 33/10; F42B 33/12

[52] U.S. Cl. ..... 86/36; 86/23; 86/25; 86/37; 86/38; 86/39; 86/41; 86/12; 29/254; 81/3.55; 81/3.47; 81/3.48

[58] Field of Search ..... 86/12, 23, 24, 25, 28, 86/29, 30, 31, 33, 36, 37, 38, 39, 40, 41; 81/3.55, 3.47, 3.48, 3.49; 29/254

[56] References Cited

U.S. PATENT DOCUMENTS

| | | | |
|---|---|---|---|
| 3,205,762 | 9/1965 | Parke | 86/12 |
| 3,973,465 | 8/1976 | Bachhuber et al. | 86/45 |
| 4,142,441 | 3/1979 | Schaenzer | 86/24 |
| 4,177,711 | 12/1979 | Lee | 86/38 |
| 4,329,906 | 5/1982 | Heers | 86/36 |
| 4,385,546 | 5/1983 | Lee | 86/36 |
| 4,522,102 | 6/1985 | Pickens | 86/27 |
| 4,590,841 | 5/1986 | Davis | 86/36 |
| 4,593,598 | 6/1986 | Gunder | 86/36 |
| 4,615,255 | 10/1986 | Carter | 86/27 |
| 4,732,073 | 3/1988 | Semon | 86/1.1 |

*Primary Examiner*—Howard J. Locker

*Attorney, Agent, or Firm*—Fleit, Jacobson, Cohn, Price, Holman & Stern

[57] ABSTRACT

A shotshell die set to facilitate reloading shotgun shells when using a commercially available press. The shotshell die set includes a depriming pin and shell holder adaptor for supporting the spent shell casing in a position to remove the spent primer from the shell casing by using the depriming pin in association with the press. A priming pin and another shell holder adaptor are utilized with the spent shell casing in order to insert a new primer in the shell casing. A sizing and crimping die together with an additional shell holder adaptor and crimping plug are utilized to enable complete reloading and reshaping of the shell by using existing devices so the shell is then ready for use in a firearm in a conventional manner.

7 Claims, 2 Drawing Sheets

FIG. 4
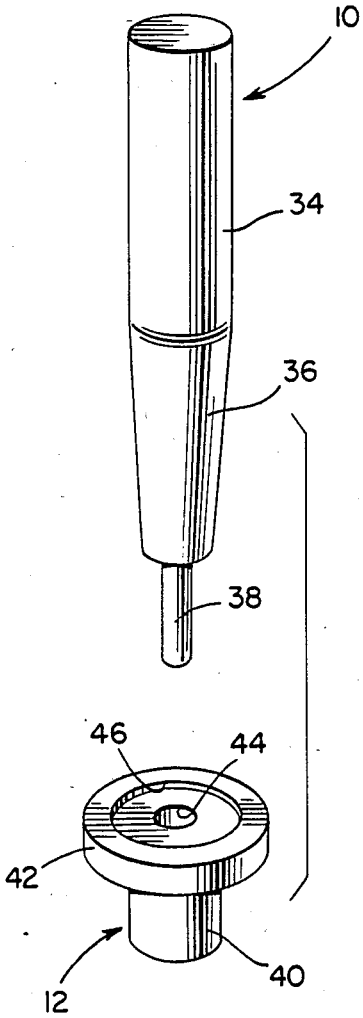
FIG. 5
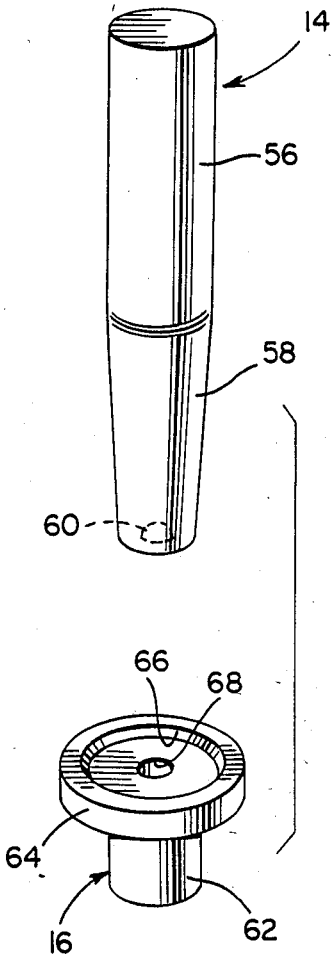
FIG. 7
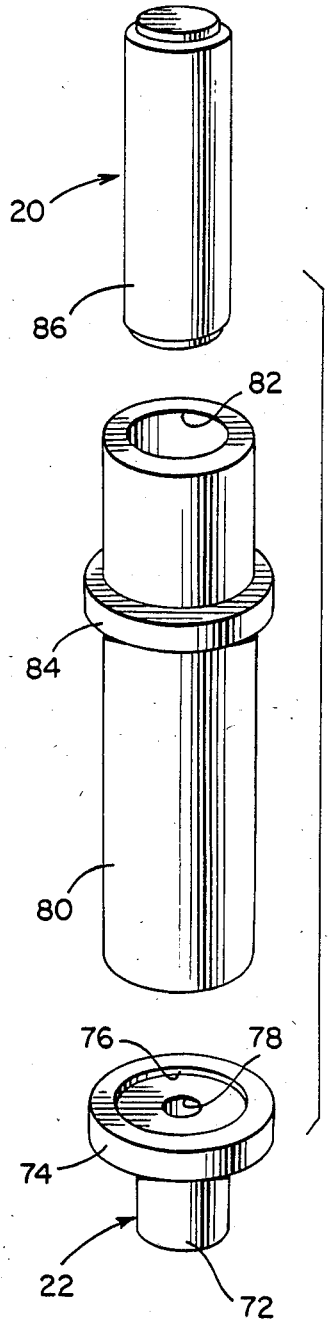
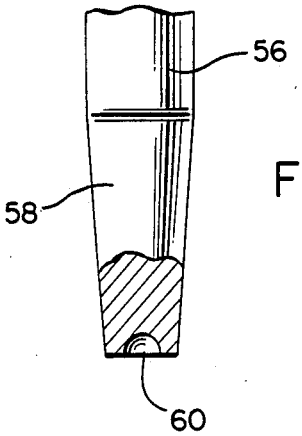
FIG. 6

SHOTSHELL DIE SET

BACKGROUND OF THE INVENTION

1. FIELD OF THE INVENTION

The present invention generally relates to a shotshell die set to facilitate reloading shotgun shells when using a commercially available press. The shotshell die set includes a depriming pin and shell holder adaptor for supporting the spent shell casing in a position to remove the spent primer from the shell casing by using the depriming pin in association with the press. A priming pin and another shell holder adaptor are utilized with the spent shell casing in order to insert a new primer in the shell casing. A sizing and crimping die together with an additional shell holder adaptor and crimping plug are utilized to enable complete reloading and reshaping of the shell by using existing devices so the shell is then ready for use in a firearm in a conventional manner.

2. INFORMATION DISCLOSURE STATEMENT

Shotgun shells are reloaded after being discharged in a shotgun by removing the primer, inserting a new primer and a powder and shell load with appropriate wadding with the shell being crimped and adapted for subsequent discharge in a shotgun. Such devices require considerable expertise and skill in properly reloading a shotgun shell. Various types of presses are commercially available for assisting in this operation and various kits are available to assist in using the press. None of the prior art and previously known devices utilize the specific structure and reloading procedure of this invention.

SUMMARY OF THE INVENTION

An object of the present invention is to provide a shotshell die set in which the depriming pin not only removes the spent primer but also cleans and resizes the primer hole and tightens any loose base wads and all of the shell holder adaptors resize, reshape and prevent any bulge or distortion to the case shell head.

Another object of the invention is to provide a shotshell die set in which the shell holder adaptor renders it impossible to deform the shell head into concave configuration due to improper seating of a new primer since the primers are always seated dead level with the shell head base, with this structure also providing a built in safety factor to avoid accidental discharge of primers during either the primer seating or the final crimping procedure.

A further object of the invention is to provide a shotshell die set in accordance with the preceding objects in which the same crimping plug can be used for either six or eight point crimping without distortion or without any change in the crimping plug with the same die and crimping plug also being used with standard length shotgun shells with no adjustment being necessary to crimp any shell of any brand of any length or any content volume.

Still another object of the invention is to provide a shotshell die set which does not require the use of any tools to change parts from one operation to another and no parts are screwed or permanently fastened to the press but yet all of the parts are automatically held solidly and securely by merely slipping them into the regular press openings with the structure of the shotshell die set also being adapted for use on any single stage press having a large hole opening to accept the shotshell die set components.

Yet another important object of the invention is to provide a shotshell die set that can be used with various other standard structures capable of use with the die set including crimp starters, wad seaters, shot and powder dispensers which are available from various sources with the shotshell die set of this invention being constructed of durable, high quality materials for use on a metallic loading press in order to reload shotshells of any gauge.

Still another feature of the invention is to provide a shotshell die set having a high capacity of reloading for a given time and adapted for different gauges of shotshells and adapted for use with various commercially available shotshells.

A final object of this invention to be specifically enumerated herein is to provide a shotshell die set in accordance with the preceding objects and which will conform to conventional forms of manufacture, be of simple construction and easy to use so as to provide a device that will be economically feasible, long-lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 4 is a group perspective view illustrating the depriming pin and shell holder adaptor used therewith.

FIG. 5 is a group perspective view of the priming pin and shell holder adaptor used therewith.

FIG. 6 is a fragmental sectional view illustrating the recess in the priming pin.

FIG. 7 is a group perspective view of the sizing and crimping die, the crimping plug and shell holder adaptor used therewith.

DESCRIPTION OF THE PREFERRED EMBODIMENT

Figure 3:
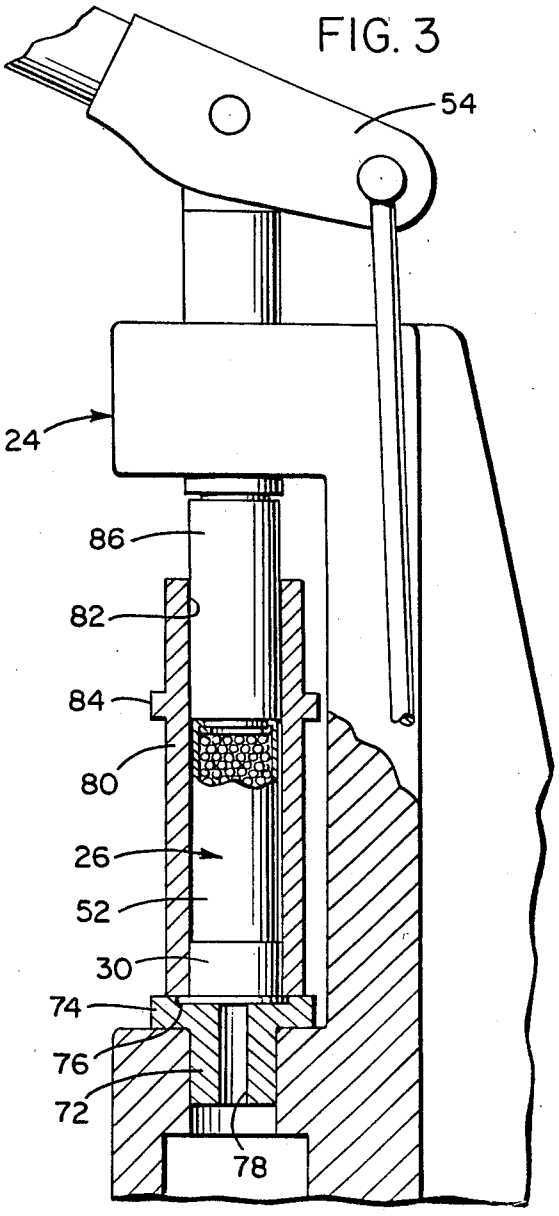
FIGS. 1, 2 and 3 illustrate schematically the sequential steps of depriming, inserting a new primer, crimping and sizing a shotshell in association with a press.
Figure 2:
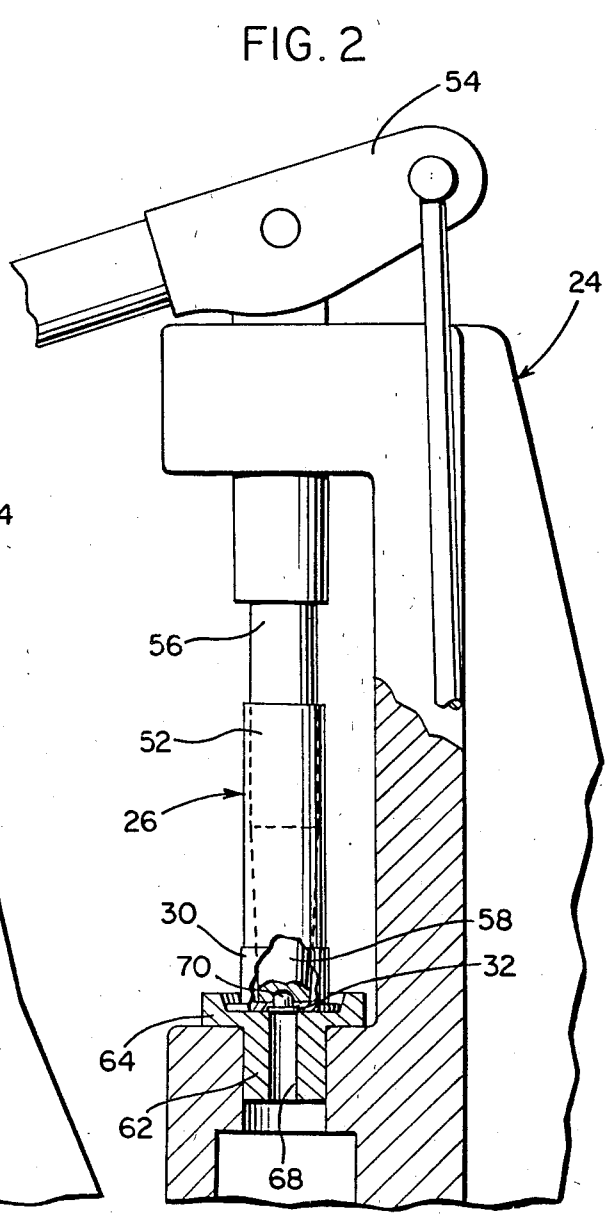
Figure 1:
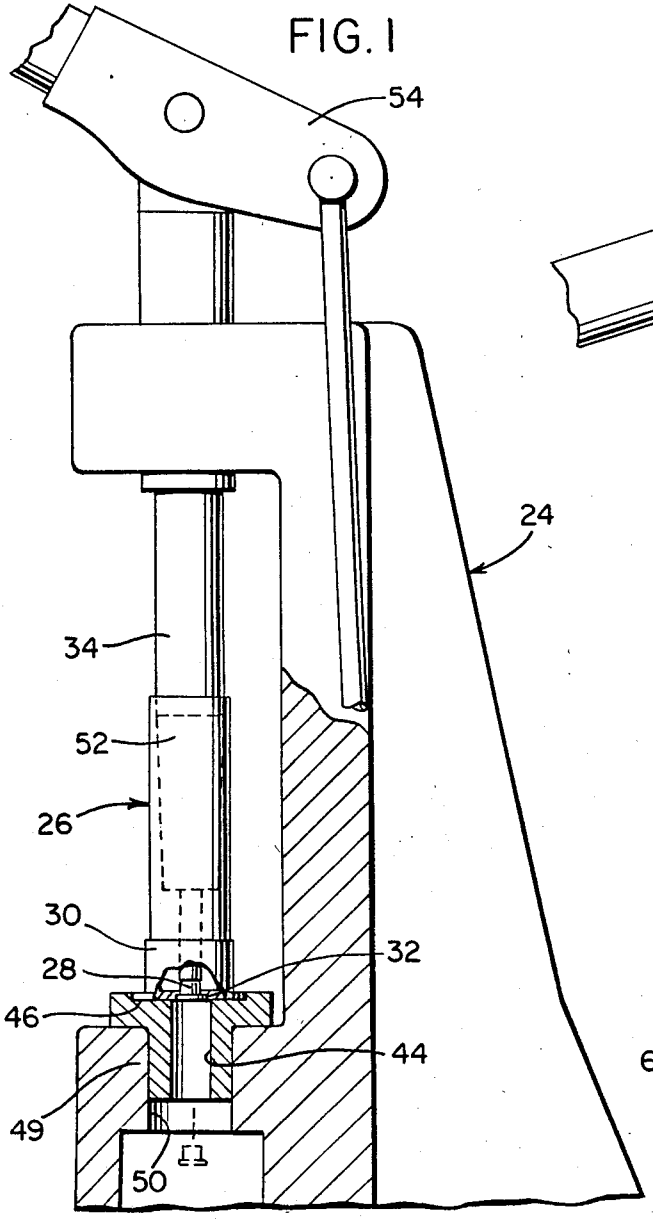

The shotshell die set of the present invention generally includes a depriming pin 10 and a shell holder adaptor 12 associated therewith, a priming pin 14 and a shell holder adaptor 16 used in association therewith and a sizing and crimping die 18, a crimping plug 20 and a shell holder adaptor 22 used in association therewith as illustrated in FIGS. 4–7, respectively, with these components being utilized in association with a conventional shotshell reloading press 24 illustrated in FIGS. 1–3.

As illustrated in FIG. 1, the shotshell generally designated by the numeral 26 is associated with the shell holder adaptor 12 in a manner to utilize the depriming pin 10 to remove a spent primer 28 from the shotshell head 30 thus leaving the primer receiving hole 32 empty for receiving a new primer.

As illustrated, the depriming pin 10 includes a cylindrical shank 34 having a tapered end portion 36 and a cylindrical and reduced diameter pin 38 which is sized to engage the spent primer 28 and force it downwardly from the primer hole 32 without distorting or damaging the shotshell casing head 30 or the primer hole 32. The shell holder adaptor includes a cylindrical body 40 having a cylindrical flange 42 at its upper end with a cylindrical bore 44 extending therethrough and a cylindrical recess 46 in its upper surface with the recess 46 receiving the rim 48 on the shotshell casing head 30 thereby aligning the spent primer 28 and primer hole 32 with the bore 44 which is of sufficient diameter to enable passage of the spent primer downwardly therethrough when forced out of the primer hole 32 as illustrated in FIG. 1. The flange 42 on the adaptor 12 is positioned in supporting engagement with the anvil 49 of the pres 24 with the cylindrical body 40 being received in a bore 50 in the anvil 49. The cylindrical body 34 and the tapered end portion 36 are received in the shotshell casing 52 as illustrated in FIG. 1 with operation of the press handle 54 causing the depriming pin 10 to be moved toward the adaptor 12 thus causing the spent primer 28 to be ejected from the primer hole 32 without distortion of the shotshell casing 52 and head 30.

In using the depriming pin 10, the shell holder adaptor 12 is slipped into the press round hole 50 and the depriming pin 10 is slipped into an empty shell 26 and the shell is then set into the recess 46 of the adaptor thus automatically aligning the shell for depriming. Then by pulling the handle 54 of the press 24, the depriming pin will punch out the spent primer 28 through the hole or bore 44 in the adaptor 12 and at the same time the depriming pin 10 will clean and resize the shell primer hole 32. This also will compact and tighten any loose base wads in the shotshell 26.

In order to reprime the shotshell 26:.the priming pin 14 is used along with the adaptor 16. The priming pin 14 includes a cylindrical body 56 having a tapered lower end portion 58 provided with a recess or indentation 60 in the lower end thereof. The shell holder adaptor 16 includes a cylindrical body 62, a cylindrical flange 64 at the upper end thereof, a tapering recess 66 in the upper end of the flange and a bore or hole 68 extending therethrough. The priming pin and shell holder adaptor are utilized when the adaptor 12 illustrated in FIG. 4 is removed and the adaptor 16 inserted into the press round hole in lieu thereof. A new primer 70 is then placed anywhere in the recess 66 of the adaptor 16 and the priming pin 14 is slipped into the deprimed shotshell case 52 and the case primer hole 32 is aligned over the new primer 70 which is quite easy since the new primer will protrude approximately 1/16 inch above the top of the flange 64 on the adaptor as illustrated in FIG. 2. Now the shell 26 is pushed towards the center of the adaptor 16 and the sides of the recess 66 which are inclined inwardly will automatically align the shotshell case head 30 dead center on the new primer 70. Now the press handle 54 can be pulled and the priming pin 14 will apply pressure on the inside case base wad and will push the shell down thus seating the new primer 70 in the primer hole 32. The recess 60 in the bottom of the priming pin 14 receives the upper end of the new primer 70 so that pressure is not exerted thereon. Since the shell is automatically aligned dead center and the hole of the adaptor is just large enough to clear the primer anvil but not the rim of the primer all of the pressure needed can be exerted to properly seat the primer to exact level of the face of the shell case base 30 with no fear that the primer anvil will ever be hit to accidentally set off or discharge the primer thereby providing a safety feature for an otherwise potentially dangerous task.

After the shotshell has been provided with a new primer 70 and the new primer has been securely pressed into the primer hole, the powder, shot wad, shot and initial shell crimping will be undertaken and the components for performing these functions are not part of the present invention since they can be obtained separately or collectively from any commercial press maker. However, the resizing and final crimping is accomplished by the sizing and crimping die 18, the crimping plug 20 and the shell holder adaptor 22 as the last step in reloading the shotshell just prior to final crimping. With this arrangement, the adaptor 16 is removed from the press and the adaptor 22 is placed in the press ram hole 50. The adaptor 22 includes a cylindrical body 72, a flange 74, a recess 76 and a bore 78 which is the same as the bore in the adaptor 16 for safety to the primer anvil and also prevents the possibility of the powder pushing or popping out any loose primers should too much pressure be exerted during the final crimping procedure. The loaded shotshell, mouth up, is placed into the bottom of the sizing die 18 which is a hollow cylindrical member 80 having a bore 82 extending therethrough and a peripheral projecting flange 84 thereon. With the shotshell loaded and positioned in the die 18 as illustrated in FIG. 3, this assembly is placed on the adaptor 22 and the press handle 54 is activated. The outer flange or ridge 84 on the die 18 will hold the die firmly in the press while the shell is forced into the sizing die 18. The handle 54 is pulled completely to fully resize the entire shotshell case base and shell rim or flange. The handle 54 is returned and crimping plug 20, in the form of a cylindrical member 86, is inserted into the bore 82 in the die 18 with the turret of the press being given a slight turn to clear the press opening. The handle 54 is again pulled to make the final crimp by exerting just enough pressure to form the crimp. Excessive pressure here will cause some compaction of the shot wad and/or shell case itself. Any bulge or displacement of the case rarely occurs because the shell 26 is solidly pressed and held in the sizing die 18. After resizing and crimping, the entire sizing die 18 with the crimping plug 20 still in place is inverted and the press turret is turned back to its normal setting and the press handle is pulled which forcing the crimping plug 20 to push the finished shell out of the top of the die 18. If too little pressure was applied when making the final crimp, the pressure required for the crimping plug 20 to push the finished shell out of the die should be sufficient to equal the pressure needed to make a good crimp. This is the reason that the resizing was the final step. If the final crimp is not satisfactory, the resizing and crimping steps can be repeated by replacing the shell in die 18. The crimping plug 20 can be removed to visually inspect the crimp during the crimping step. By using the die 18 and crimping plug 20, the amount of pressure exerted on the crimping plug compensates for variations in shell capacity, volume, contents, length and the like without using any fixed adjustments.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A shotshell die set for use with a shell reloading press for removing a spent primer, placing a new primer in place in the shell head, resizing the shell after loading with powder, shot and wadding and crimping the open end of the shell casing, said die set comprising an adaptor for mounting in a press ram hole in the reloading press, said adaptor including an upwardly facing recessed surface receiving the rim of a shotshell case head, said adaptor including a centrally disposed bore extending therethrough sized to permit downward gravitational movement of a spent primer and a depriming pin mounted in the reloading press for movement downwardly into the open end of a shotshell with the pin including a reduced axial lower end sized to engage a spent primer and push it downwardly out of the primer hole in the shotshell case head and clean and size the primer hole, and a primary pin and adaptor to insert a new primer in the primer hole in the shotshell case head, said adaptor including an upwardly facing surface having a recess therein receiving the rim of the shotshell case head, said adaptor including a bore therethrough sized to engage the rim of a primer but not the anvil of the primer, the recess in the surface of the adaptor being of substantially less height than the height of the primer to enable the primer to be placed in the recess and the shotshell case head engaged with the primer with the primer at least partially inserted into the primer hole, said priming pin including a tapered lower end having a recess therein to receive the portion of the primer inserted through the primer hole and to exert downward force on the interior surface of the shotshell case head peripherally of the primer hole to complete insertion of the primer into the primer hole, the peripheral edge of the recess being upwardly and outwardly inclined to center the rim on the shotshell case head with respect to the adaptor to properly align the primer with the bore through the adaptor thereby assuring proper alignment of the shotshell case head, the adaptor, primer, primer hole and priming pin.

2. The die set as defined in claim 1 together with a resizing die, adaptor and crimping plug for resizing the shotshell after being loaded with powder, shot and wadding and final crimping the shotshell case and pushing a finished shell out of the resizing die, said adaptor including a recess in the upper surface and a bore therethrough sized to be larger than the primer so as not to exert pressure on the primer, said sizing die including a cylindrical bore therethrough of a size to correspond with the gauge of the shotshell in order to resize the shotshell case to that size with the bore through the die receiving the shell having been loaded with powder, shot and wadding with the open end extending upwardly, said crimping plug including a cylindrical member telescoped closely into the resizing die to engage the free end of the shotshell case and crimp it inwardly, said resizing die with crimping plug and finished shell therein being inverted in the press so that the crimping plug can be utilized to push the finished shell out of the resizing die.

3. A priming pin and adaptor for inserting a new primer into a primer hole of a shotshell case head, said adaptor including an upwardly facing surface having a recess therein receiving the rim of the shotshell case head, said adaptor including a bore therethrough sized to engage the rim of a primer but not the anvil of the primer, the recess in the surface of the adaptor being of substantially less height than the height of the primer to enable the primer to be placed in the recess and the shotshell case head engaged with the primer with the primer at least partially inserted into the primer hole, said priming pin including a tapered lower end having a recess therein to receive the portion of the primer inserted through the primer hole and to exert downward force on the interior surface of the shotshell case head peripherally of the primer hole to complete insertion of the primer into the primer hole, the peripheral edge of the recess being upwardly and outwardly inclined to center the rim on the shotshell case head with respect to the adaptor to properly align the primer with the bore through the adaptor thereby assuring proper alignment of the shotshell case head, the adaptor, primer, primer hole and priming pin.

4. The die set of claim 3 together with a resizing and crimping die comprising a resizing die, adaptor and crimping plug for resizing the shotshell after being loaded with powder, shot and wadding and final crimping the shotshell case and pushing a finished shell out of the resizing die, said adaptor including a recess in the upper surface and a bore therethrough sized to be larger than the primer so as not to exert pressure on the primer, said sizing die including a cylindrical bore therethrough of a size to correspond with the gauge of the shotshell in order to resize the shotshell case to that size with the bore through the die receiving the shell having been loaded with powder, shot and wadding with the open end extending upwardly, said crimping plug including a cylindrical member telescoped closely into the resizing die to engage the free end of the shotshell case and crimp it inwardly, said resizing die with crimping plug and finished shell therein being inverted in the press so that the crimping plug can be utilized to push the finished shell out of the resizing die.

5. The method of removing a spent primer from a discharged shotshell consisting of the steps of supporting the shotshell case head on a surface having a recess for positioning the shotshell case head rim with the recess having a cavity formed therein to enable downward gravitational movement of a spent primer from the primer hole, and a depriming pin having an end portion sized to engage the inner end of a spent primer and sized to clean and resize the primer hole, inserting the depriming pin into the open end of the shotshell case and engaging it with the inner end of the spent primer and exerting a downward pressure on the depriming pin sufficient to force the spent primer out of the primer hole and to clean and resize the primer hole, and inserting a new primer in a discharged shotshell after the spent primer has been removed consisting of the steps of positioning a new primer on a recessed surface having a cavity therein sized to supportingly engage the rim of the new primer but not the anvil of the new primer, positioning a shotshell case head in engagement with the new primer by positioning the primer hole downwardly over the inner end of the new primer, inserting a primer pin having a recess in the lower end thereof into the shotshell and engaging the recess with the inner end of the primer to position the primer in relation to the cavity in the recessed surface, and forcing the shotshell case head downwardly by exerting force on the primer pen to force the new primer into the shotshell case head until the primer is flush with the surface of the shotshell head.

6. The method of claim 5 together with the step of resizing and crimping a shotshell that has been provided with a new primer, powder, shot and wadding consisting of the steps of supporting the shotshell rim on a recessed supporting surface having a cavity to engage the shotshell head outwardly of the new primer, positioning a resizing die over the entire length of the shotshell outwardly of the rim to shape and size the shotshell casing and inserting a crimping plug in the upper end of the resizing die and exerting inward pressure thereon to crimp the end of the reloaded shotshell.

7. The method as defined in claim 6 together with the step of inverting the resizing die with the crimping plug and finished shotshell in the resizing die and exerting longitudinal force on the crimping plug to push the finished shell out of the resizing die.

* * * * *